US008821198B2

(12) United States Patent
Harada

(10) Patent No.: US 8,821,198 B2
(45) Date of Patent: Sep. 2, 2014

(54) SURFACE MOUNTED ELECTRICAL CONTACT

(75) Inventor: Yohei Harada, Tokyo (JP)

(73) Assignee: Tyco Electronics Japan G.K., Kanagawa-ken (JP)

( * ) Notice: Subject to any disclaimer, the term of this patent is extended or adjusted under 35 U.S.C. 154(b) by 0 days.

(21) Appl. No.: 13/420,251

(22) Filed: Mar. 14, 2012

(65) Prior Publication Data

US 2012/0171909 A1 Jul. 5, 2012

Related U.S. Application Data

(63) Continuation of application No. PCT/JP2010/005537, filed on Sep. 10, 2010.

(30) Foreign Application Priority Data

Sep. 14, 2009 (JP) ..... 2009-211645

(51) Int. Cl.
*H01R 4/48* (2006.01)

(52) U.S. Cl.
USPC ..... 439/862; 439/66

(58) Field of Classification Search
USPC ..... 439/862, 66, 81; D13/154
See application file for complete search history.

(56) References Cited

U.S. PATENT DOCUMENTS 6,688,893 B1 * 2/2004 Huang et al. ..... 439/66
7,455,556 B2 * 11/2008 Mendenhall et al. ..... 439/862

FOREIGN PATENT DOCUMENTS

| | | |
|---|---|---|
| GB | 2392322 | 7/2005 |
| JP | D1108677 | 3/2001 |
| JP | 2002015801 | 1/2002 |
| JP | 200455243 | 2/2004 |
| JP | 2005129374 | 5/2005 |
| JP | 2005209501 | 8/2005 |
| JP | 2009032440 | 2/2009 |

OTHER PUBLICATIONS

PCT Search Report, International Application No. PCT/JP2010/005537, dated Apr. 11, 2012, 5 pages.
International Search Report for co-pending International Application No. PCT/JP2010/005537, dated Oct. 12, 2010, 2 pages.

* cited by examiner

*Primary Examiner* — Vanessa Girardi
(74) *Attorney, Agent, or Firm* — Barley Snyder

(57) ABSTRACT

An electrical contact is provided for electrically connecting a connecting object to a printed circuit board, without the need of a housing. The electrical contact a board mounting portion, a spring region, and a contact portion. The board mounting portion extends parallel to the major surface of the printed circuit board with one end mounted thereto. The spring region extends from another end of the board mounting portion and having a holding portion that extends parallel to the major surface of the printed circuit board and an inclined portion that extends vertically from the holding portion and with respect to the printed circuit board. The contact portion connects to the inclined portion of the spring region and includes a curved shape with a connecting object contact point at a top of a curved part.

10 Claims, 7 Drawing Sheets

SURFACE MOUNTED ELECTRICAL CONTACT

CROSS-REFERENCE TO RELATED APPLICATION

This application is a continuation of PCT International Application No. PCT/JP2010/005537 filed Sep. 10, 2010, which claims priority under 35 U.S.C. §119 to Japanese Patent Application No. 2009-211645, filed Sep. 14, 2009.

FIELD OF THE INVENTION

The invention relates to an electrical contact and, more particularly, to an electrical contact for electrically connecting an object to a printed circuit board for use in a battery connection in a mobile phone, a ground connection between printed circuit boards, and an antenna connection in a mobile terminal called smartphone in which a mobile phone or a PHS and personal digital assistance (PDA) are integrated.

BACKGROUND

A known electrical contact for electrically connecting a connecting object to a printed circuit board, for example, is shown in FIG. 8 (see JP Registration of Design Number 1108677).

A known electrical contact 101 shown in FIG. 8 electrically connects a chassis 120 that is a connecting object to a printed circuit board 110. The known electrical contact 101 is integrally formed by stamping and forming a metal sheet, and is provided with a solder connecting portion 102 and a contact portion 104. The solder connecting portion 102 is formed into a substantially rectangular plate shape, and has a solder connecting surface 102*a* extending horizontal with respect to and soldered onto a printed circuit board 110. The contact portion 104 is arranged at an end of a spring region 103 extending from a back end (right end in FIG. 8) of the solder connecting portion 102. The spring region 103 includes an upstanding portion 103*a* standing up from the back end of the solder connecting portion 102, and an extending portion 103*b* extending frontward through a curved portion from an upper end of the upstanding portion 103*a*. The contact portion 104 protrudes upward from an end (front end) of the extending portion 103*b*, and is bent into a reverse U shape. The chassis 120 comes into contact with the contact portion 104 at the top thereof Then, an elongated portion 105 extends frontward from an end of the contact portion 104.

Additionally, a pair of side walls 106 extend along both side edges of the front end of the solder connecting portion 102, and a top wall 107 extends from an upper end of each side wall 106 toward a midpoint of the solder connecting portion 102. The elongated portion 105 is in contact with a lower surface of the top wall 107 to receive a preload, when the chassis 120 is not in contact with the contact portion 104. The side walls 106 and the top wall 107 prevent the elongated portion 105 from turning upward. Furthermore, the chassis 120 abutting the top wall 107 prevents an excessive stress from being applied onto the spring region 103.

Another known electrical connector is shown in FIG. 9A and FIG. 9B (see JP 2009-32440 A), which includes an electrical contact for electrically connecting a connecting object to a printed circuit board.

A known electrical connector 200 shown in FIG. 9A and FIG. 9B includes a housing 210, plural electrical contacts 220, a pair of pegs 230, and a cover 240.

Each electrical contact 220 is configured to electrically connect a battery pack (not shown) that is a connecting object to a printed circuit board (not shown) provided on a mobile phone main body. Each electrical contact 220 is integrally formed by stamping and forming a metal sheet, and is provided with a securing portion 221, a solder connecting portion 222, and a contact portion 223. The securing portion 221 extends vertical with respect to the printed circuit board, and is formed to have a U shape when viewed from the top thereof, as shown in FIG. 9A. The securing portion 221 is press-fitted and secured into slits 211 of the housing 210 from the bottom side of the housing 210. The solder connecting portion 222 is arranged at the lower edge of the securing portion 221, as shown in FIG. 9B. The solder connecting portion 222 extends parallel to the major surface of the printed circuit board from the lower edge of the securing portion 221, and is soldered and connected onto the printed circuit board. The contact portion 223 is positioned at an end of a spring region 224 through the spring region 224 extending substantially perpendicular to the securing portion 221 from a side edge of the securing portion 221. The contact portion 223 is formed into a curved shape, with which a connecting object conies into contact parallel to the major surface of the printed circuit board.

A pair of pegs 230 are provided for securing the housing 10 to the printed circuit board, and are press-fitted and secured into grooves 212 arranged on both ends of a longitudinal direction of the housing 210, respectively. In addition, the cover 240 is attached onto the housing 210 to protect the spring regions 224 of the electrical contacts 220. The contact portion 223 extends from an opening 241 arranged in the cover 240, and permits the connecting object to come into contact with the printed circuit board from the horizontal direction with respect thereto.

Furthermore, as yet another known electrical contact is shown in FIG. 10 (see JP 2004-55243 A), for electrically connecting the connecting object to the printed circuit board.

A known electrical contact 301 shown in FIG. 10 is configured to electrically connect a battery pack (not shown) that is a connecting object to a printed circuit board 340 provided on a mobile phone main body. The known electrical contact 301 is provided with a conductive cylindrical portion 310, a spring 320 positioned in a receiving space 311 of the cylindrical portion 310, and a contact pin 330. The cylindrical portion 310 extends parallel to the major surface of the printed circuit board 340. The contact pin 330 is slidably supported in the receiving space 311 of the cylindrical portion 310 and becomes conductive with the cylindrical portion 310. The contact pin 330 is biased by the spring 320 and an end portion thereof protrudes from the cylindrical portion 310. The connecting object comes into contact with the contact pin 330 parallel to the major surface of the printed circuit board 340. In addition, an outer circumference of the cylindrical portion 310 includes a plurality of connecting protrusions 312 positioned in alignment with respect to the cylindrical portion 310 and protruding in a direction intersecting with the longitudinal direction. The bottom surfaces of the connecting protrusions 312 are soldered and connected onto the printed circuit board 340. Furthermore, a holding portion 313 having a plane surface for vacuum suction is arranged on an opposite side of the connecting protrusions 312, on the outer circumference of the cylindrical portion 310.

However, in the battery connection in a mobile phone or an antenna connection in a mobile terminal called smartphone, these days, there is a need for connecting a connecting object to a printed circuit board with use of only a lone electrical contact(s) and without use of a housing. Main reasons of this need include downsizing, cost reduction, and increased variation of the contact arrangement. The increased variation of the contact arrangement means that since the use of housing makes the contacts arranged at a pitch determined by the housing, the contacts can be arranged on the printed circuit board freely, without limiting to this.

In a case where only a lone electrical contact is used without the housing, it is necessary for a component mounting apparatus to suction the lone electrical contacts when the electrical contact(s) is mounted on the printed circuit board. In addition, in reflow soldering and connecting the lone electrical contact(s) onto the printed circuit board, it is necessary for the contact to stand up by itself on the solder paste of the printed circuit hoard.

Furthermore, in the battery connection in a mobile phone, the antenna connection in a mobile terminal, and the like, these days, there is a need that the connecting object can be brought into contact with the electrical contact mounted on the printed circuit board from both of a horizontal direction and a vertical direction with respect to the printed circuit board.

It is to be noted that, however, the following problems exist in the known electrical contacts 101, 220, and 301 shown in FIG. 8 to FIG. 10.

That is, as to the known electrical contact 101 shown in FIG. 8, the upper surface of the extending portion 103*b* is formed to be flat and can be used as a suction surface, and simultaneously, the solder connecting portion 102 can stand up by itself on the solder paste of the printed circuit board 110. Also, as the contact point of the contact portion 104 with the chassis 120 (connecting object) faces upward, the connecting object can be brought into contact with the contact point from a vertical direction with respect to the printed circuit board. However, it is impossible to make the connecting object come into contact with the contact portion 104 from a horizontal direction with respect to the printed circuit board. This is because the pair of the side walls 106 and the top wall 107 are arranged on the front side of the contact portion 104 and they become obstacles when the connecting object passes.

Further more, as to the electrical contacts 220 shown in FIG. 9A and FIG. 9B, they are made to stand up by themselves. However, since there is no surface that can be used as a suction surface, the lone electrical contact 220 cannot be suctioned. Therefore, the upper surface of the housing 210 is used as a suction surface. Besides, although the connecting object comes into contact with the contact portion 223 from the horizontal direction with respect to the printed circuit board, the connecting object cannot come into contact from the vertical direction with respect to the printed circuit board.

Furthermore, as to the known electrical contact 301 shown in FIG. 10, it can be suctioned at the holding portion 313, and in addition, can stand up by itself on the printed circuit board 340 with the connecting protrusions 312. Moreover, the connecting object can come into contact with the contact pin 330 from the horizontal direction with respect to the printed circuit board 340. However, the connecting object cannot come into contact with the contact pin 330 from the vertical direction with respect to the printed circuit board 340. Additionally, the known electrical contact 301 shown in FIG. 10 is composed of three parts including the cylindrical portion 310, the spring 320, and the contact pin 330, whereby there are a number of parts and its costs are high. Besides, when the space 311 of the cylindrical portion 310 or the contact pin 330 is produced, a machining process is needed and its manufacturing costs are also high.

SUMMARY

Therefore, the invention has been made in view of the above problems, and has an object, among others, to provide an electrical contact for electrically connecting a connecting object to a printed circuit board. The electrical contact can be suctioned and stand up by itself on a printed circuit board without the use of a housing, so that a connecting object comes into contact with the electrical contact from both of horizontal and vertical directions with respect to the printed circuit board. A single electrical contact is needed and a machining process is not needed, thereby resulting in a low cost.

An electrical contact is provided for electrically connecting a connecting object to a printed circuit board, without the need of a housing. The electrical contact a board mounting portion, a spring region, and a contact portion. The board mounting portion extends parallel to the major surface of the printed circuit board with one end mounted thereto. The spring region extends from another end of the board mounting portion and having a holding portion that extends parallel to the major surface of the printed circuit board and an inclined portion that extends vertically from the holding portion and with respect to the printed circuit board. The contact portion connects to the inclined portion of the spring region and includes a curved shape with a connecting object contact point at a top of a curved part.

BRIEF DESCRIPTION OF THE DRAWINGS

The objects, features and advantages of the invention will become more apparent by describing in detail embodiments thereof with reference to the accompanying drawings, in which.

DETAILED DESCRIPTION OF THE EMBODIMENT(S)

Figure 1:
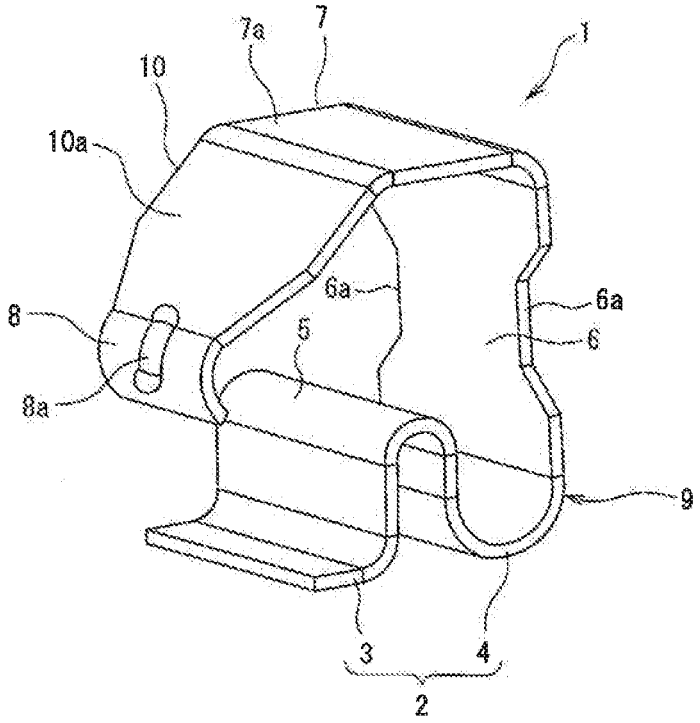
FIG. 1 is a perspective view of an electrical contact according to the invention, when viewed from the front.
Figure 2:
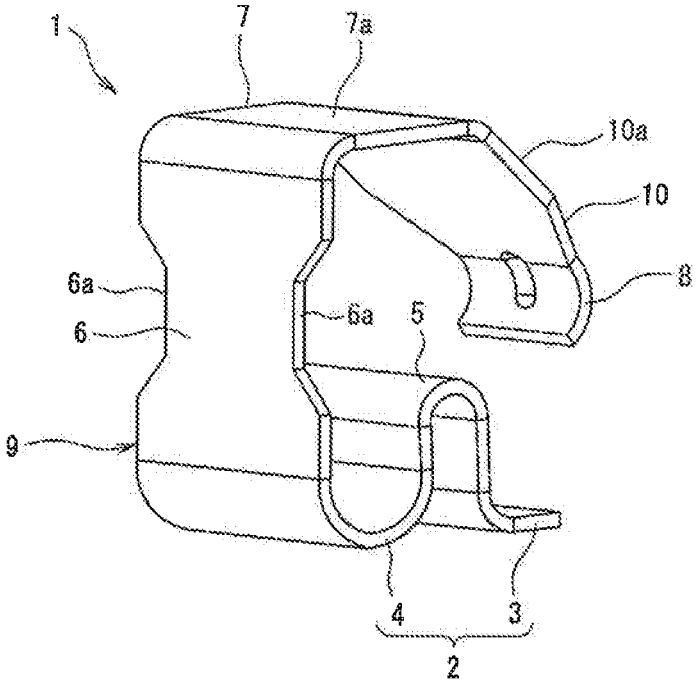
FIG. 2 is another perspective view of the electrical contact shown in FIG. 1 when viewed from the rear.

Hereinafter, embodiments of the present invention will be described with reference to the drawings.

An electrical contact 1 shown in FIG. 1 to FIG. 7 is configured to electrically connect a connecting object 20 to a PCB (Printed Circuit Board). The electrical contact 1 is used for, for example, a battery connection in a mobile phone, a ground connection between the printed circuit boards, an antenna connection in a mobile terminal called smartphone, and the like. A single electrical contact 1 or multiple electrical contacts 1 are employed according to the purpose.

Herein, the electrical contact 1 is an integrated part formed by stamping and forming a metal sheet. The electrical contact 1 includes a board mounting portion 2 for being mounted on the printed circuit board PCB having a shape extending parallel to the major surface of the printed circuit board PCB. As the board mounting portion 2 is mounted on the printed circuit board PCB, the lone electrical contact 1 is capable of standing up by itself on the solder paste upon reflow soldering. The board mounting portion 2 is provided with a solder connecting portion 3 and a board contact portion 4.

The solder connecting portion 3 is formed into a rectangular plate shape extending parallel to the major surface of the printed circuit board PCB, and is soldered and connected onto the printed circuit board PCB. The board contact portion 4 is arranged at a rear side proximately to the solder connecting portion 3 (the right-side part in FIG. 6), and is formed having a U shape for contact with the printed circuit board PCB. A bent portion 5 having a reverse U shape is provided between the solder connecting portion 3 and the board contact portion 4. The functions and effects of the bent portion 5 will be described later.

Then, the electrical contact 1 includes a contact portion. 8 arranged through a spring region 9 to the solder connecting portion 3, and a holding portion 7 disposed along the spring region 9. The spring region 9 is composed of the bent portion 5, the board contact portion 4, an upstanding portion 6 standing up from the board contact portion 4, the holding portion 7 extending from the upstanding portion 6, and a inclined portion 10.

Figure 5:
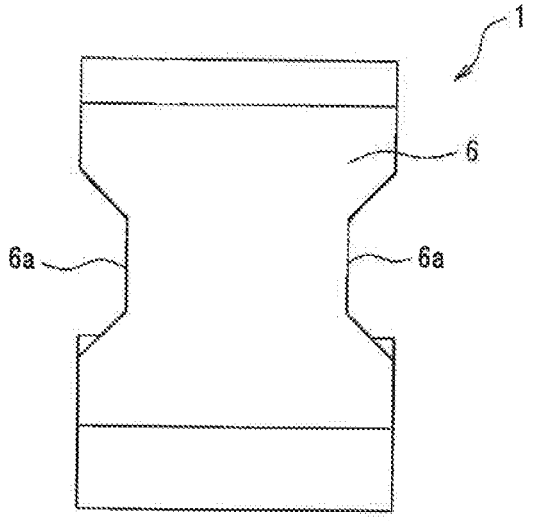
FIG. 5 is a back view of the electrical contact shown in FIG. 1.

The upstanding portion 6 extends upward from the board contact portion 4, and is formed into a substantially rectangular shape when viewed from the back surface, as shown in FIG. 5. A pair of cutouts 6*a* are formed on both sides of the upstanding portion 6.

Figure 3:
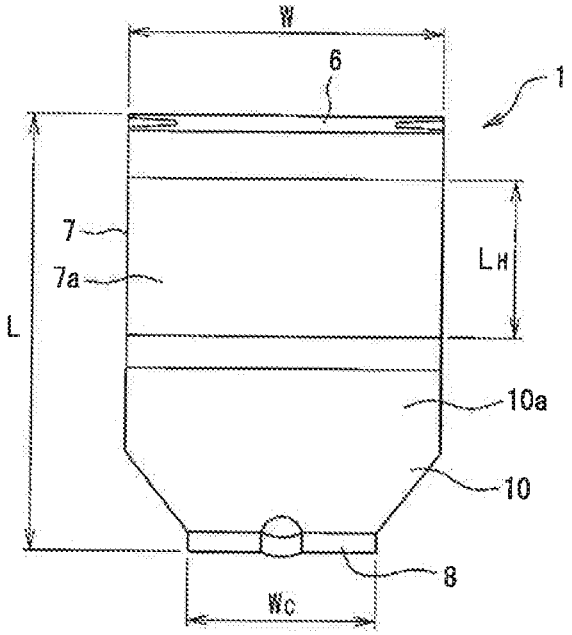
FIG. 3 is a plan view of the electrical contact shown in FIG. 1.
Figure 4:
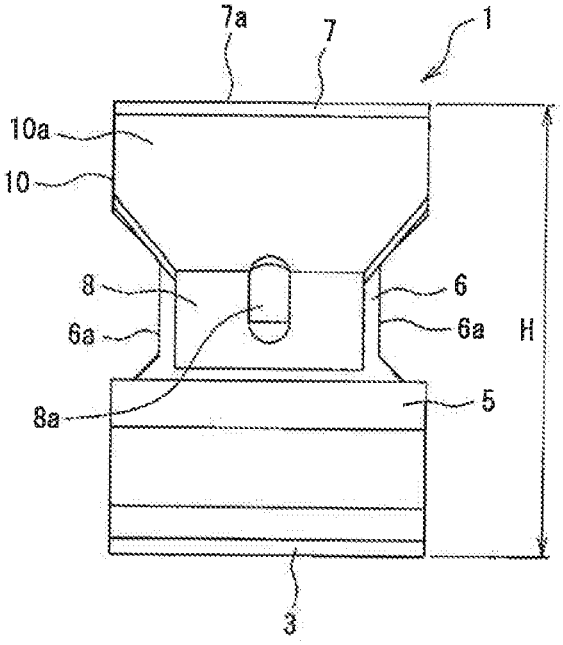
FIG. 4 is a front view of the electrical contact shown in FIG. 1

The holding portion 7 has a horizontal surface 7*a* extending frontward parallel to the major surface of the printed circuit board PCB from an upper end of the upstanding portion 6. The plane shape of the horizontal surface 7*a* is substantially a rectangle, as shown in FIG. 3. The lone electrical contact 1 can be suctioned by a part mounting apparatus by use of the horizontal surface 7*a* of the holding portion 7. A height H (see FIG. 4) from the bottom surface of the solder connecting portion 3 to the horizontal surface 7*a* of the holding portion 7 is approximately 2.86 mm in the shown embodiment. Additionally, a width W (see FIG. 3) of the holding portion 7 and a width of the upstanding portion 6 is approximately 2 mm in the shown embodiment. Furthermore, a length LH (see FIG. 3 and FIG. 6) of the horizontal surface 7*a* is approximately 1.0 mm in the shown embodiment.

Figure 6:
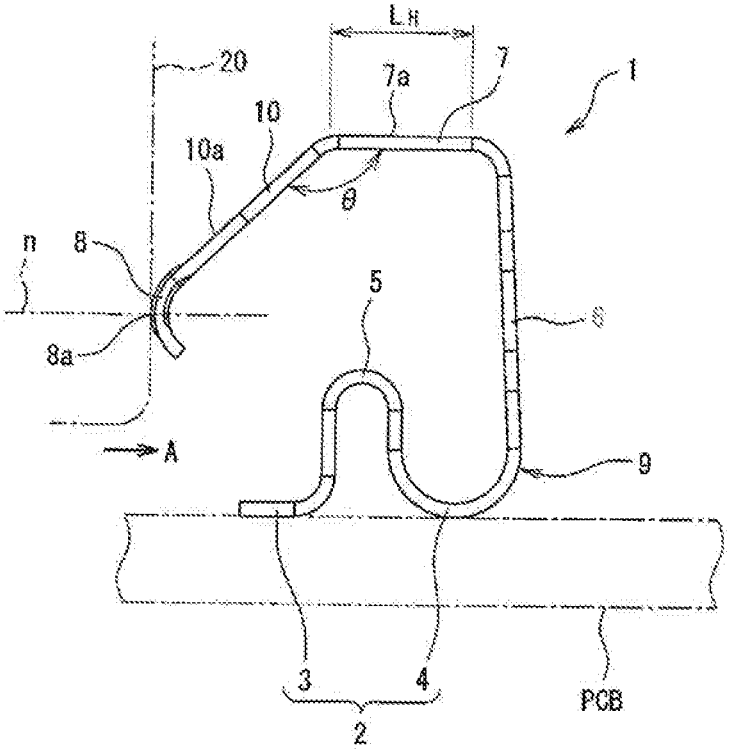
FIG. 6 is a right side view of the electrical contact shown in FIG. 1 positioned on a printed circuit board and a connecting object that comes into contact with the electrical contact.

The contact portion 8 is curved to be brought into contact with the connecting object 20. The contact portion 8 has the top of the curved part that is a contact point 8*a* for contact with the connecting object 20, as shown in FIG. 6 specifically, and a normal line n at the contact point 8*a* extends parallel to the major surface of the printed circuit board PCB. In addition, the contact portion 8 extends through the inclined portion 10 having a inclined portion 10*a* slanting from the holding portion 7 vertically with respect to the printed circuit board PCB. The inclined portion 10*a* is formed into a linear shape. A slant angle θ (see FIG. 6) of the inclined portion 10 with respect to the holding portion 7 is approximately 136 degrees in the shown embodiment. In addition, a width WC (see FIG. 3) of the contact portion 8 is approximately 1.2 mm in the shown embodiment. Furthermore, a length L (see FIG. 3) from the back surface of the upstanding portion 6 to the front end in the front direction of the contact portion 8 is approximately 2.8 mm in the shown embodiment.

Next, a method of mounting the electrical contact 1 on the printed circuit board PCB will be described Firstly, the electrical contact 1 is mounted on the printed circuit board PCB by the board mounting portion 2, as shown in FIG. 6, so that the lone electrical contact 1 stands up by itself on the printed circuit board PCB. In this operation, the lone electrical contact 1 can be suctioned by the part mounting apparatus by use of the horizontal surface 7*a* of the holding portion 7. Here, the solder connecting portion 3 of the board mounting portion 2 is located on the solder paste on a conductive pad (not shown) of the printed circuit board PCB. In this situation, since the board mounting portion 2 has a shape extending parallel to the major surface of the printed circuit board PCB, the electrical contact 1 hardly falls down.

Subsequently, the board mounting portion 2 is reflow soldered and connected Thus, the electrical contact 1 is mounted on the printed circuit board PCB.

Herein, as only the lone electrical contact 1 is mounted on the printed circuit board PCB without using a housing, downsizing and cost reduction can be achieved. Then, since the housing is not used, the variation in the contact arrangement can be set freely.

Next, a method of bringing the connecting object 20 into contact with the electrical contact 1 mounted on the printed circuit board PCB will be described.

As shown in FIG. 6, when the connecting object 20 is connected to the electrical contact 1 parallel to the major surface of the printed circuit board PCB (an arrow A direction, that is, a direction from front to back), a conductive pad (not illustrated) provided at the connecting object 20 comes into contact with the contact point 8*a* of the contact portion 8 from the horizontal direction with respect to the printed circuit board PCB. In this situation, as the normal linen at the contact point 8*a* extends parallel to the major surface of the printed circuit board PCB, the connecting object 20 comes into contact with the contact point 8*a* with no difficulty in particular. Accordingly, the connecting object 20 is electrically connected with the printed circuit board PCB. Then, the connecting object 20 is further pushed horizontally, the spring region 9 deforms, and the contact portion 8 moves to a predefined position horizontally. In this state, the contact is completed, and the electrical contact 1 has a structure that a stress is easily concentrated on the holding portion 7 in the spring region 9. However, the cutouts 6*a* are disposed on both side portions of the upstanding portion 6 so that the stress is dispersed to the upstanding portion 6.

Figure 7:
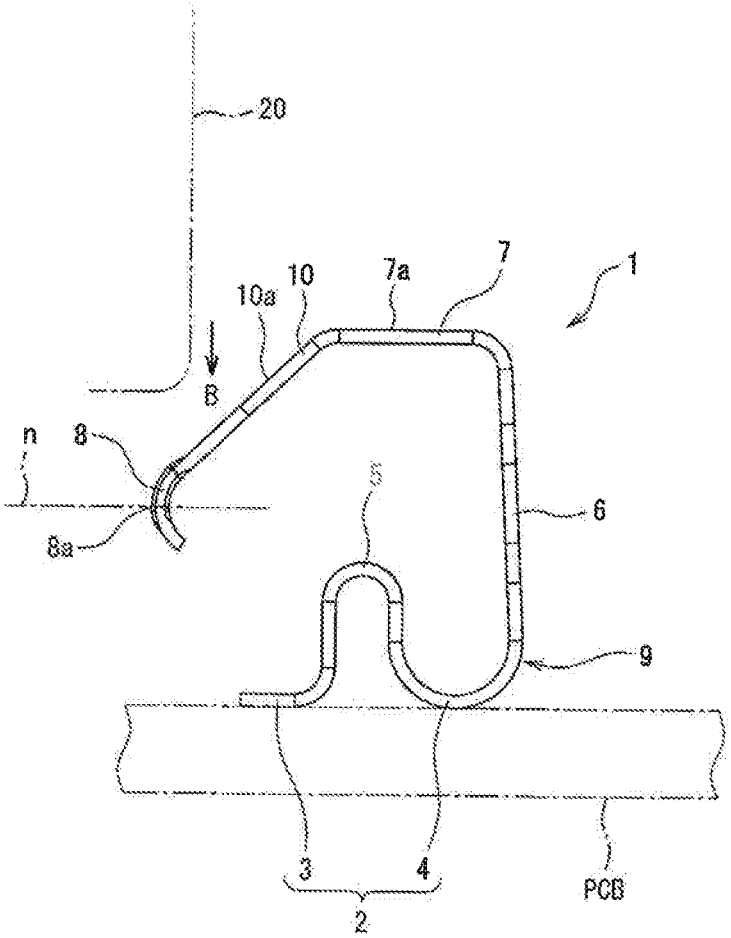
FIG. 7 is another right side view of the electrical contact shown in FIG. 1 positioned on a printed circuit board and a connecting object that comes into contact with the electrical contact.
Figure 8:
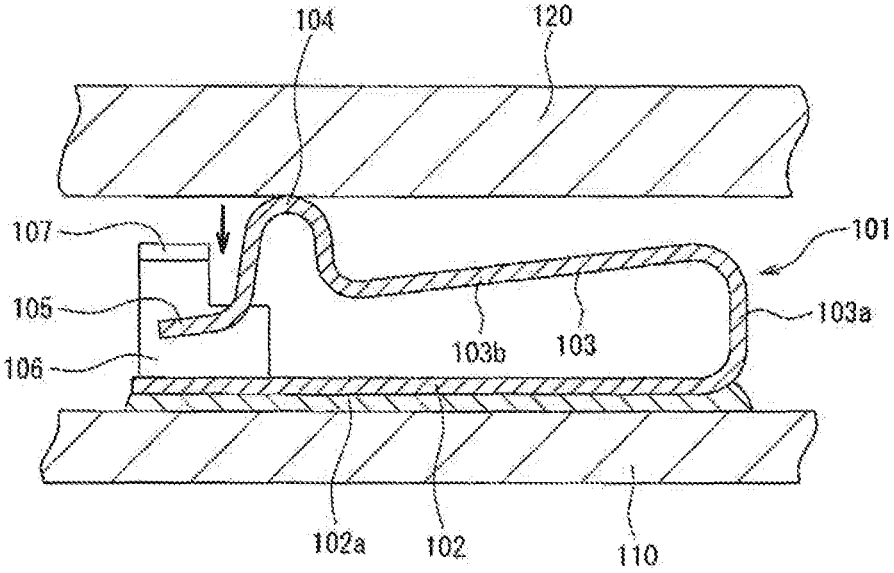
FIG. 8 PRIOR ART
FIG. 8 is a crosssectional view showing a known electrical contact together with a printed circuit board and a chassis.
Figure 9A:
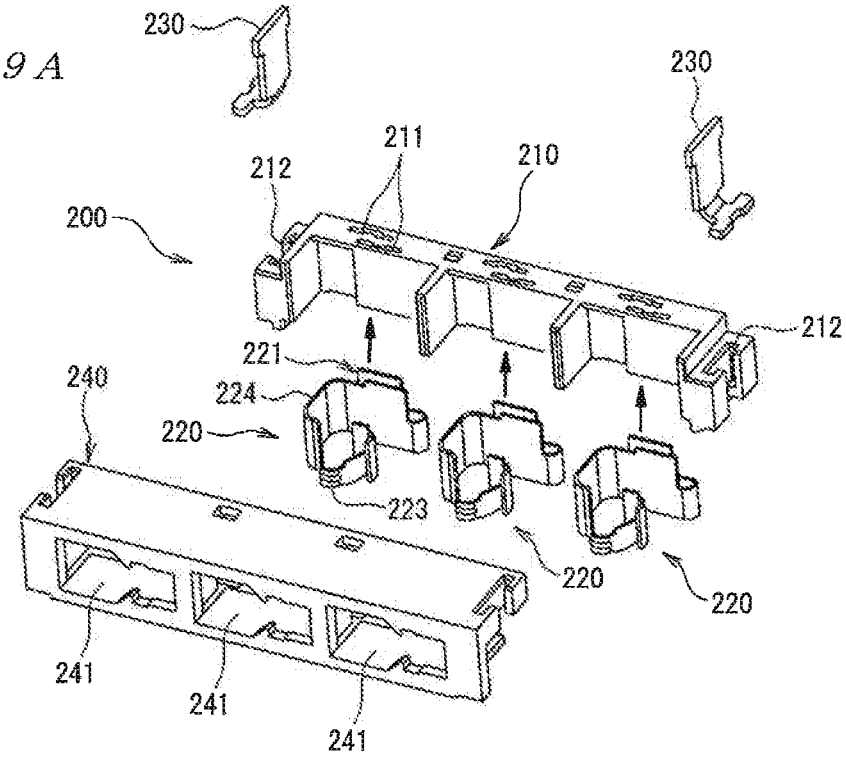
FIG. 9A PRIOR ART
FIG. 9A is an exploded front perspective view of a known electrical connector having an electrical contact.
Figure 9B:
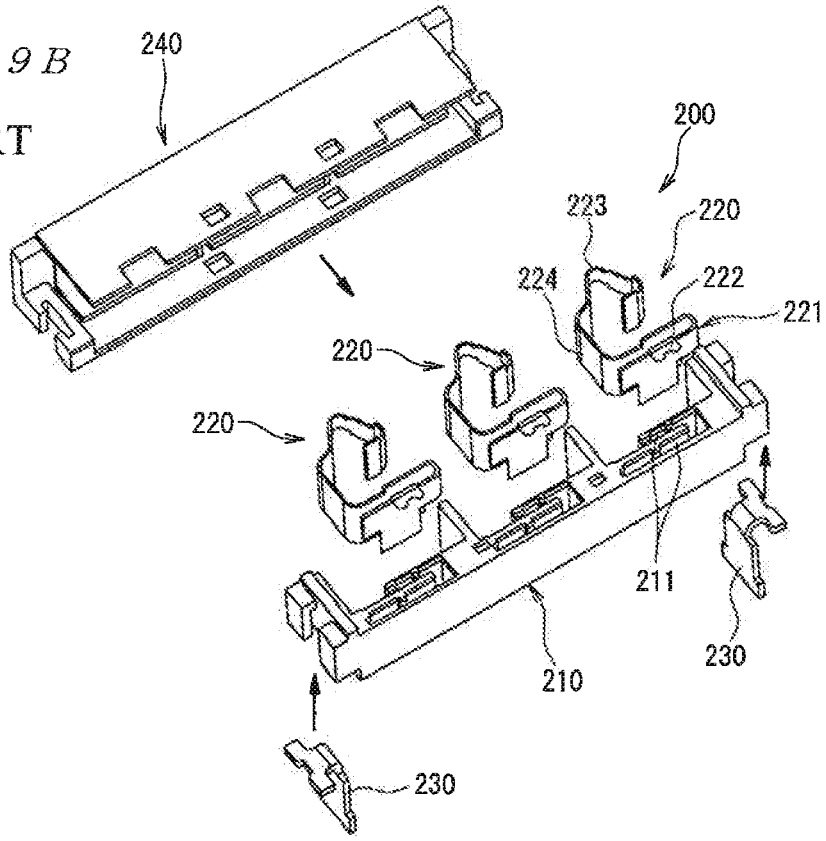
FIG. 9B PRIOR ART
FIG. 9B is an exploded rear perspective view of the known electrical connector shown in FIG. 9A.
Figure 10:
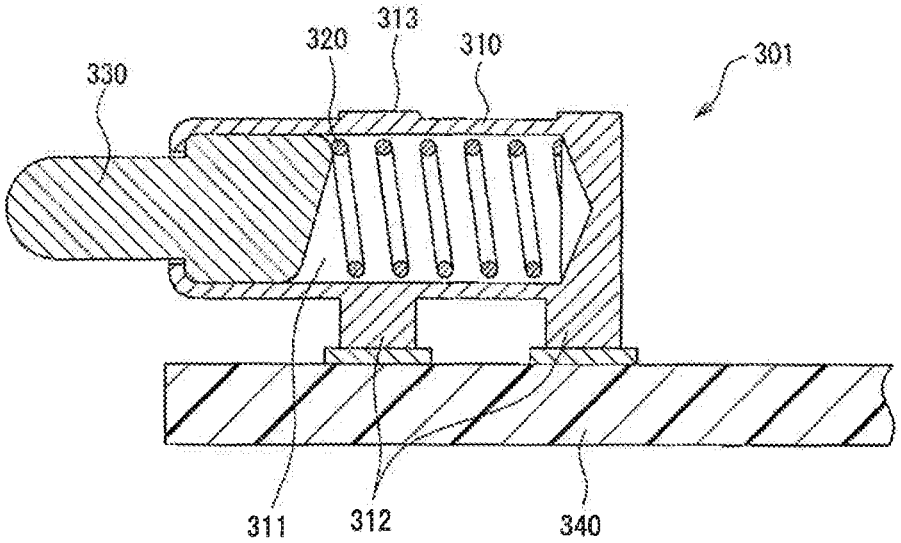
FIG. 10 PRIOR ART
FIG. 10 is a cross-sectional view showing yet another known electrical contact together with the printed circuit hoard.

In contrast, as shown in FIG. 7, when the connecting object 20 is connected to the electrical contact 1 from the vertical direction with respect to the printed circuit board PCB (an arrow B direction, that is, a direction from up to down), firstly, the connecting object 20 conies into contact with the inclined portion 10*a* of the inclined portion 10. Then, the connecting object 20 is further pushed vertically, and the connecting object 20 moves downward while moving the inclined portion 10 and the contact portion 8. Accordingly, the spring region 9 deforms, and the contact point 8*a* of the contact portion 8 moves to a predefined position horizontally and is brought into contact with the conductive pad of the connecting object 20. Thus, the connecting object 20 is electrically connected to the printed circuit board PCB, and the contact is completed.

In this manner, in the shown embodiment, in the contact portion 8, since the normal line n at the contact point 8*a* extends parallel to the major surface of the printed circuit board PCB, the connecting object 20 can be brought into contact with the contact portion 8 from the horizontal direction with respect to the printed circuit board PCB. Additionally, the contact portion 8 extends through the inclined portion 10*a* slanting from the holding portion 7 vertically with respect to the printed circuit board PCB, whereby the connecting object 20 can be brought into contact with the contact portion 8 from the vertical direction with respect to the printed circuit board PCB via the inclined portion 10*a*.

Furthermore, the electrical contact 1 is formed of a metal sheet, and is provided with the solder connecting portion 3 for being soldered and connected onto the printed circuit board PCB, and the curved contact portion 8 arranged through the spring region 9 to the solder connecting portion 3 to be brought into contact with the connecting object 20. Therefore, as an electrical contact connecting a connecting object to a printed circuit board, it is possible to provide an electrical contact for electrically connecting the connecting object to the printed circuit board, whereby its cost can be low with the need of only a single part and without the need of a machining process.

Next, functions and effects of the bent portion 5 will be described.

As shown in FIG. 6, the front end of the board mounting portion 2, the solder connecting portion 3, is positioned on the back side of the contact point 8*a* of the contact portion 8. This is caused by a limitation in the layout. In this case, since the contact point 8*a* of the contact portion 8 protrudes from the front end of the board mounting portion 2 (the solder connecting portion 3), the load applied onto the contact portion 8 may cause the electrical contact 1 to fall down, when the electrical contact 1 is made to stand up by itself on the printed circuit board PCB. However, the design of the bent portion 5 between the solder connecting portion 3 and the board contact portion 4 increases the weight at the board mounting portion 2 by the weight of the bent portion 5. Therefore, when the electrical contact 1 is made to stand up by itself on the printed circuit board PCB, it is possible to avoid the electrical contact 1 from falling down due to the load applied onto the contact portion 8 as much as possible.

Additionally, the design of the bent portion 5 having the reverse U shape elongates the spring length in the spring region 9 by the length of the bent portion 5.

Furthermore, the design of the bent portion 5 having the reverse U shape causes the bent portion 5 to function as a cushion for the solder connecting portion 3, and reduces the load applied to the solder connecting portion 3.

Moreover, the design of the bent portion 5 having the reverse U shape prevents the solder from rising to the contact portion 8, and also has a function of reducing the rigidness of the spring region 9 due to the solder.

Specifically, in the shown embodiment, the inclined portion 10*a* has a linear shape. The inclined portion 10*a* may have a curved shape or a bent shape. However, when the inclined portion 10*a* is formed into a curved shape or a bent shape, the contact portion 8 including the contact point 8*a* formed by curving might be merged with the curved part of the inclined portion 10*a* and the location of the contact portion 8 might move to the inclined portion 10*a* side. In such a case, since the spring length of the spring region 9 is shortened, it is preferable that the inclined portion 10*a* have a linear shape.

Heretofore, the embodiments of the invention have been described. However, the invention is not limited to them and various modifications and improvements may occur.

For example, the board mounting portion 2 is composed of the solder connecting portion 3 and the board contact portion 4 such that the solder connecting portion 3 is arranged at a part of the hoard mounting portion 2. However, the board mounting portion 2 may be composed of the solder connecting portion 3. In this case, the solder connecting portion 3 is elongated to the base end of the upstanding portion 6 to eliminate the board contact portion 4 and the bent portion 5.

Additionally, the dimensions of the electrical contact 1 (including the height H from the bottom surface of the solder connecting portion 3 to the horizontal surface 7*a* of the holding portion 7, the width W of the holding portion 7 and the width of the upstanding portion 6, the length LH in front-back direction of the horizontal surface 7*a*, the slant angle θ of the inclined portion 10 with respect to the holding portion 7, the width WC of the contact portion 8, and the length L from the back surface of the upstanding portion 6 to the front end in the front direction of the contact portion 8) are not limited to the examples described in the shown embodiment.

Although the exemplary embodiment of the invention has been disclosed for illustrative purposes, those skilled in the art will appreciate that various modifications, additions and substitutions are possible, without departing from the scope and spirit of the invention as disclosed in the accompanying claims.

What is claimed is:

1. An electrical contact comprising:

a spring region having:

an upstanding portion extending perpendicular to a major surface of a printed circuit board, a holding portion extending from the upstanding portion and being parallel to and spaced apart from the major surface, and an inclined portion extending from an end of the holding portion;

a contact portion extending from an end of the inclined portion; and a board mounting portion extending parallel to the major surface and having:

a board contact portion connected at a first end to the upstanding portion, and a solder connecting portion connected to a second end of the board contact portion opposite the first end through a bent portion, wherein an outer surface of the holding portion is suctionable by a part mounting apparatus.

2. The electrical contact of claim 1, wherein the bent portion is reverse U-shaped and positioned remotely from the major surface.

3. The electrical contact of claim 1, wherein the bent portion is oriented angularly from the major surface.

4. The electrical contact of claim 1, wherein the electrical contact is self-supported by the solder connection portion and board contact portion in contact with the major surface.

5. The electrical contact of claim 4, wherein the bent portion is reverse U-shaped and positioned remotely from the major surface.

6. An electrical contact comprising:

two major continuous surfaces and four distinct edges within which is defined a board mounting portion extending parallel to a major surface of a printed circuit board;

a spring region extending from the board mounting portion and having an upstanding portion extending generally perpendicular from the board mounting portion to a holding portion, the holding portion extending from the upstanding portion in parallel to and spaced apart from the board mounting portion, and an inclined portion extending from the holding portion; and a contact portion having a curved shape and extending from the inclined portion.

7. The electrical contact of claim 6, wherein the board mounting portion comprises a solder connecting portion, and a board contact portion having a first end connected to the upstanding portion, and a second end connected to the solder connecting portion.

8. The electrical contact of claim 7, wherein the board contact portion and the solder connecting portion are joined to each other by a bent portion.

9. The electrical contact of claim 8, wherein the bent portion is reverse U-shaped and positioned remotely from the major surface.

10. The electrical contact of claim 8, wherein the bent portion is oriented angularly from the major surface.

* * * * *